US007083406B2

(12) United States Patent
Stoller et al.

(10) Patent No.: US 7,083,406 B2
(45) Date of Patent: Aug. 1, 2006

(54) VIBRATION SYSTEM FOR CONCRETE PIPE MAKING MACHINES

(75) Inventors: David Stoller, Burlington, IA (US); Jon A. Schmidgall, Mediapolis, IA (US)

(73) Assignee: Hawkeye Concrete Products Co., Mediapolis, IA (US)

( * ) Notice: Subject to any disclaimer, the term of this patent is extended or adjusted under 35 U.S.C. 154(b) by 327 days.

(21) Appl. No.: 10/605,178

(22) Filed: Sep. 12, 2003

(65) Prior Publication Data

US 2005/0058740 A1 Mar. 17, 2005

(51) Int. Cl.
*B28B 21/28* (2006.01)

(52) U.S. Cl. ..... 425/456; 425/432

(58) Field of Classification Search ..... 425/432, 425/421, 424, 456, 262; 264/72
See application file for complete search history.

(56) References Cited

U.S. PATENT DOCUMENTS 1,810,583 A * 6/1931 Tuerck ..... 264/278
3,201,843 A * 8/1965 Osweiler ..... 425/413
4,109,097 A * 8/1978 Berry ..... 174/86
4,708,621 A 11/1987 Schmidgall et al.

* cited by examiner

*Primary Examiner*—Joseph S. Del Sole
*Assistant Examiner*—Veronica Ewald
(74) *Attorney, Agent, or Firm*—James C. Nemmers

(57) ABSTRACT

A vibration system for concrete pipe making machines which system utilizes a precisely manufactured inner mold core that contains mounting surfaces for two coupling shaft bearings and two electric vibrators. The bearing mounting surfaces are accurately located with respect to the electric vibrator mounting surfaces to allow the mold core to become the vibration structure. Jaw-type coupling hubs are keyed and fixed to each end of a coupling shaft with each electric vibrator also having a jaw-type coupling hub fixed to one end of its eccentric weights. The eccentric weights of both electric vibrators are aligned upon assembly in the core.

4 Claims, 4 Drawing Sheets

VIBRATION SYSTEM FOR CONCRETE PIPE MAKING MACHINES

BACKGROUND OF INVENTION

This invention relates to machines and processes for manufacturing concrete products, such as concrete pipe, manholes, catch basins, and the like, and more specifically, the invention relates to the "dry-cast" method of manufacturing concrete products which requires a system for providing vibration to the core of the concrete mold during the fill and pressure-head cycles of the manufacturing process.

In the dry-cast method of manufacturing, concrete vibration is necessary to consolidate the concrete products prior to curing. The inner mold, or core, of a concrete mold therefore contains a vibration system normally consisting of eccentric weights mounted on a central shaft driven by electric or hydraulic motors. An example of a dry cast concrete pipe making machine using a vibration system is show in U.S. Pat. No. 4,708,621.

For optimum consolidation of the concrete products produced by the dry-cast method, it is desirable to have the vibration distributed evenly along the entire length of the mold. Many current systems make use of a separate vibration unit which is assembled outside of the core. These systems contain a central shaft or shafts, supported by a series of bearings, to which eccentric weights are fixed. The shaft assembly is mounted in a structural tube which is then fastened inside the core of a concrete mold. These vibration units are either driven by a directly mounted hydraulic or electric motor or by coupling to an external drive unit. These prior art vibration units are made so that they can be removed and placed in cores of other sizes, where adjustment of the eccentric weights may be required because cores of different masses require different vibration output for optimum performance.

In some other prior art systems, multiple electric vibrators are mounted inside the core and are coupled with shafts fastened to and supported by the vibrator shafts. This type of system requires suitable access to allow alignment and fastening of each vibrator and coupling shaft. In small diameter cores, limited access makes installation and removal of such systems difficult because when removing or replacing the electric vibrators, the coupling shafts must also be removed. There is therefore a need for an improved vibration system that will provide advantages over the existing prior art systems.

SUMMARY OF INVENTION

The invention provides for a vibration system which utilizes a precisely manufactured inner mold core that contains mounting surfaces for two coupling shaft bearings and two electric vibrators. The bearing mounting surfaces are accurately located with respect to the electric vibrator mounting surfaces. This allows the mold core to become the vibration structure. The electric vibrator mounting surfaces are at each end of the core, and the coupling shaft, supported by two bearings, is of such diameter to allow it to span between the vibrators without excessive deflection. A jaw-type coupling hub is keyed and fixed to each end of the coupling shaft. Each electric vibrator also has a jaw-type coupling hub fixed to one end of its eccentric weights. The eccentric weights of both electric vibrators are aligned upon assembly in the core. The coupling shaft along with the two support bearings are installed first in the core. The electric vibrators are then installed by aligning the coupling hubs and fastening to the mounting surfaces. The vibrator eccentric weights are set exactly for the core they are being installed in and no further adjustment is required. Because of the novel arrangement of the system of the invention, the electric vibrators can be completely removed without disturbing the coupling shaft.

DETAILED DESCRIPTION

Figure 1:
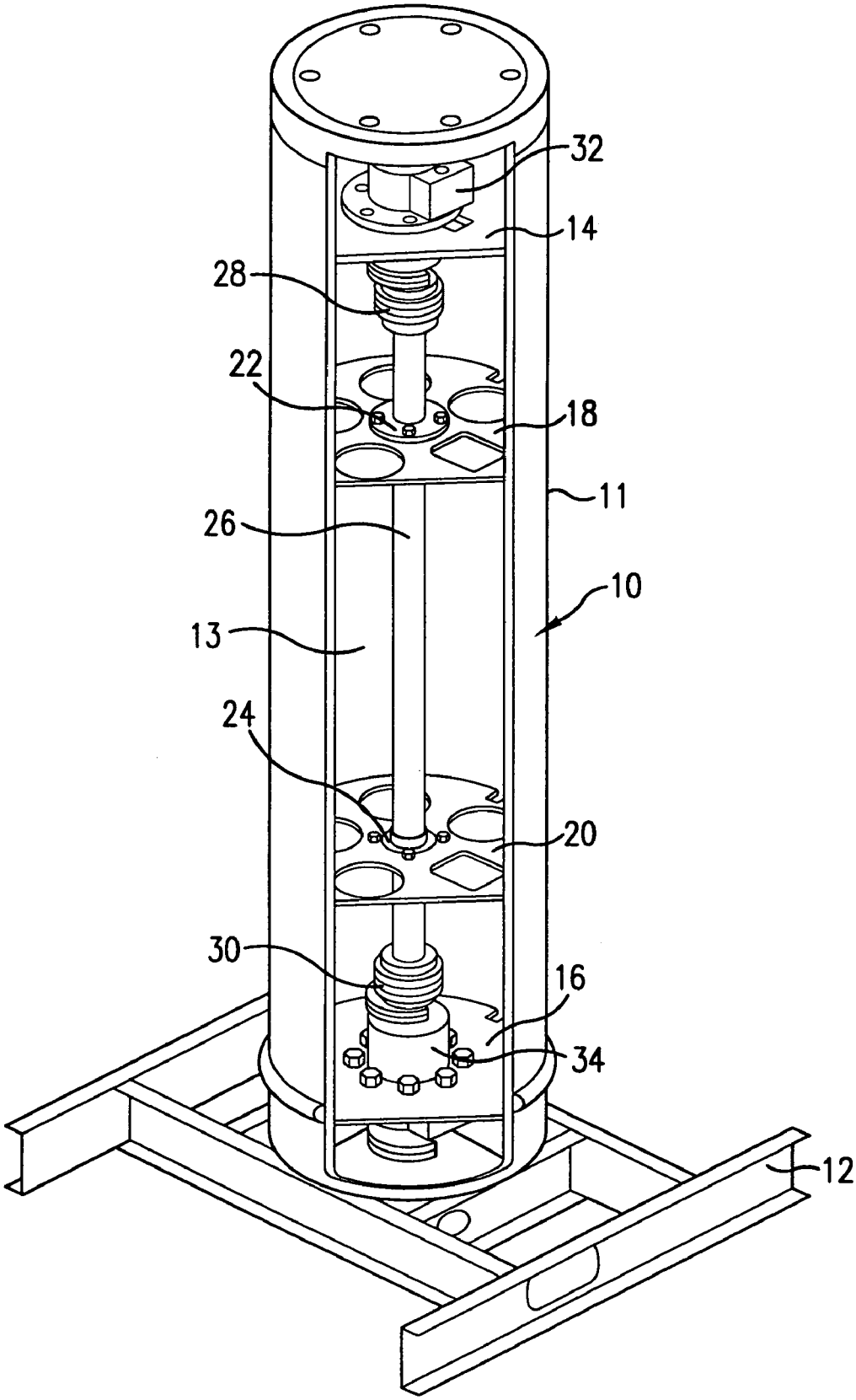
FIG. 1 is a perspective view of an inner core or mold of a pipe making machine with the vibration system of the invention in place.
Figure 2:
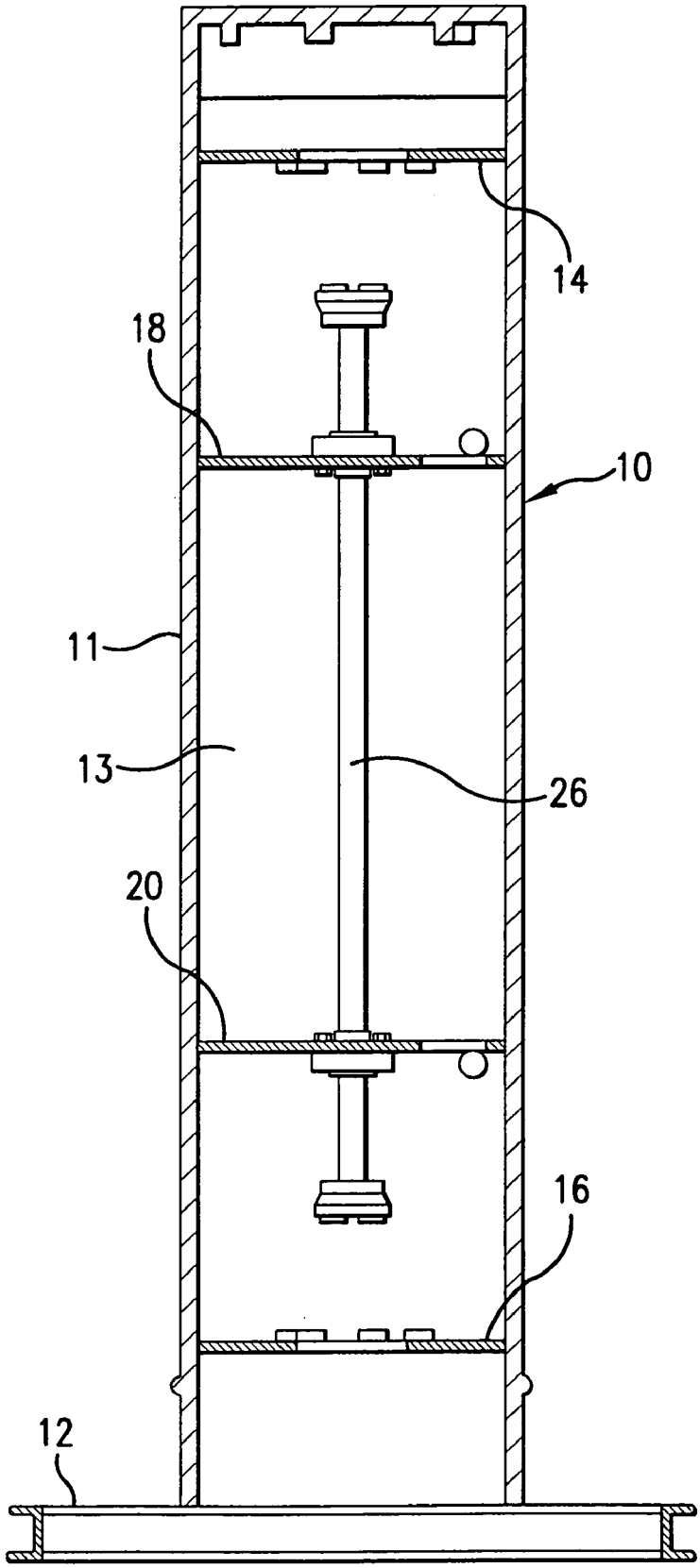
FIG. 2 is A side elevational view of the inner mold with a portion of the mold broken away and with the vibrator assemblies removed to illustrate the coupling shaft and its mounting inside the mold.

Referring first to FIGS. 1 and 2, there is shown a typical inner mold 10 of a cylindrical shape for producing a round concrete pipe. The inner mold 10 has a wall 11 with an inner surface that defines an interior space 13 having a longitudinal axis and a diameter substantially equal to the outer diameter of the mold 10. The inner mold 10 can also be of an elliptical, rectangular or other geometric configuration depending upon the type of concrete pipe being produced. The inner mold 10 is supported on suitable supporting structure 12 and extends vertically to form the core of the mold. As is well know to those skilled in the art, a jacket or outer mold (not shown) is lowered over and surrounds the inner mold 10 to create an annular space into which concrete is poured to form the concrete pipe.

Welded or otherwise suitably secured inside of the inner core 10 are an upper vibrator mounting plate 14 and a lower vibrator mounting plate 16. In addition, there are secured inside of the inner core 10 vertically-spaced apart upper bearing mounting plate 18 and lower bearing mounting plate 20. As shown in FIGS. 1 and 2, bearing plates 18 and 20 are positioned between the vibrator mounting plates 14 and 16 and are accurately located with respect to the vibrator mounting plates 14 and 16. It is important that the bearing mounting plates 18 and 20 provide bearing mounting surfaces that are concentric to, parallel with, and a specific distance from, the vibrator mounting surfaces provided by the vibrator mounting plates 14 and 16. To achieve concentricity, as well as a machined mounting surface to achieve the desired parallelism, both the bearings and electric vibrators that are mounted on the mounting plates as described hereinafter should have machined pilot diameters. The bearing mounting plates 18 and 20 support shaft bearings 22 and 24 which in turn support a rotatable coupling shaft 26. Mounted on and rotatable with the coupling shaft 26 are an upper shaft coupling hub 28 and a lower shaft coupling hub 30. As shown, the coupling hubs 28 and 30 are interiorly of the vibrator mounting plates 14 and 16, and each is of the jaw type having a plurality of outwardly projecting teeth or jaws 29. The coupling hubs 28 and 30 are keyed to the coupling shaft 26 so that the jaws 29 of the hubs are exactly aligned from end to end.

Figure 4:
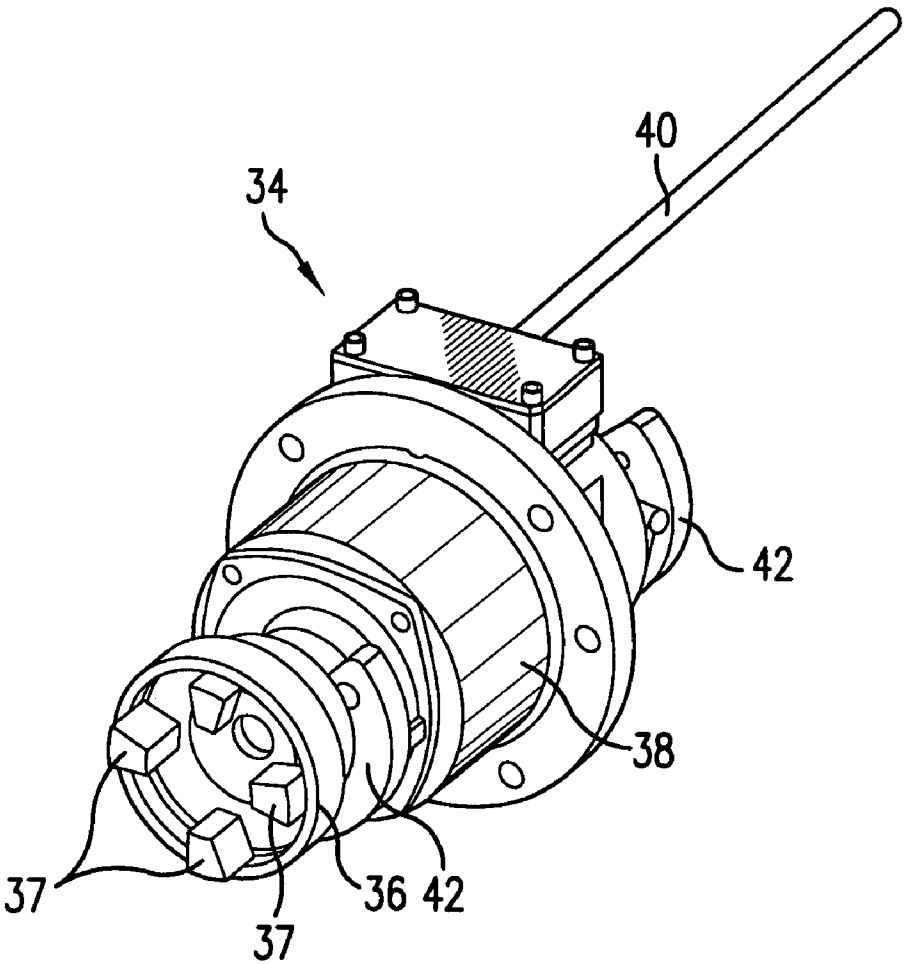
FIG. 4 is a perspective view of the lower vibrator assembly.
Figure 3:
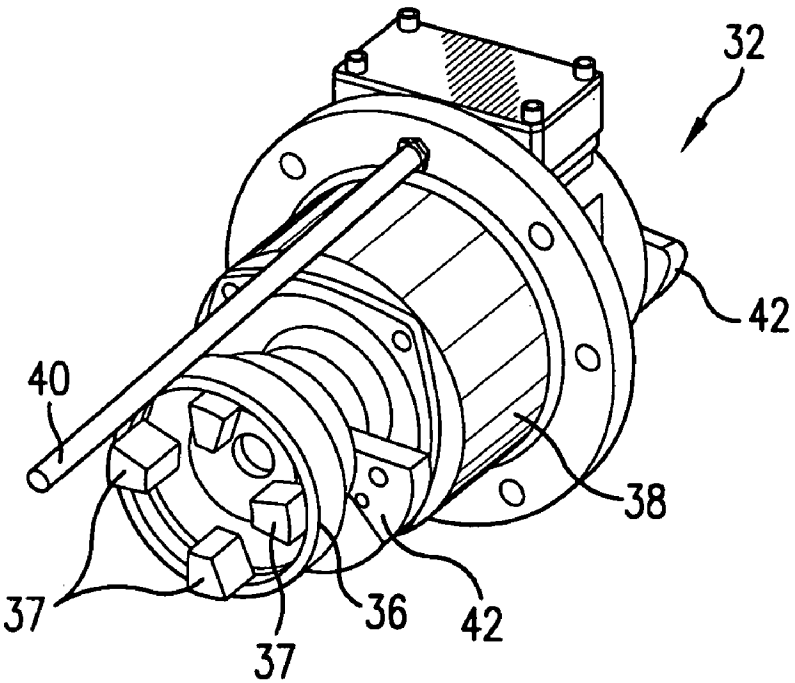
FIG. 3 is a perspective view of the upper vibrator assembly.

The assembly described thus far is illustrated in the elevational view of FIG. 2. This assembly forms the synchronizing assembly of the inner mold 10 that can be connected to an upper vibrator assembly 32 and a lower vibrator assembly 34 which are mounted on the upper vibrator mounting plate 14 and lower vibrator mounting plate 16, respectively. The basic synchronizing assembly of FIG. 2 is manufactured for and becomes a part of each inner mold of a pipe making machine. Obviously, concrete products of different sizes require molds of different sizes. However, using the principles of the invention, the same vibrator assemblies can be used for all the molds regardless of size because of the unique design that provides for connection of the synchronizing assembly with the vibrator assemblies. These assemblies 32 and 34 are shown in FIGS. 3 and 4, respectively, and since the assemblies 32 and 34 are substantially identical, only one of them will be described with the same components of each assembly having the same reference numerals. Each vibrator assembly 32 and 34 has a vibrator coupling hub 36 of the jaw type having a plurality of outwardly projecting jaws 37. Each vibrator coupling hub 36 is driven by an electric motor 38 which receives power from a power source through power cord 40. Hydraulic motors could be used as well. The motor 38 of each assembly 32 and 34 drives eccentric weights 42 that when driven, create the desired vibration in the inner mold 10 which becomes the vibration structure. The coupling hubs 36 are also fastened to the vibrator eccentric weights 42 in a specific alignment as more fully described hereinafter.

Figure 5:
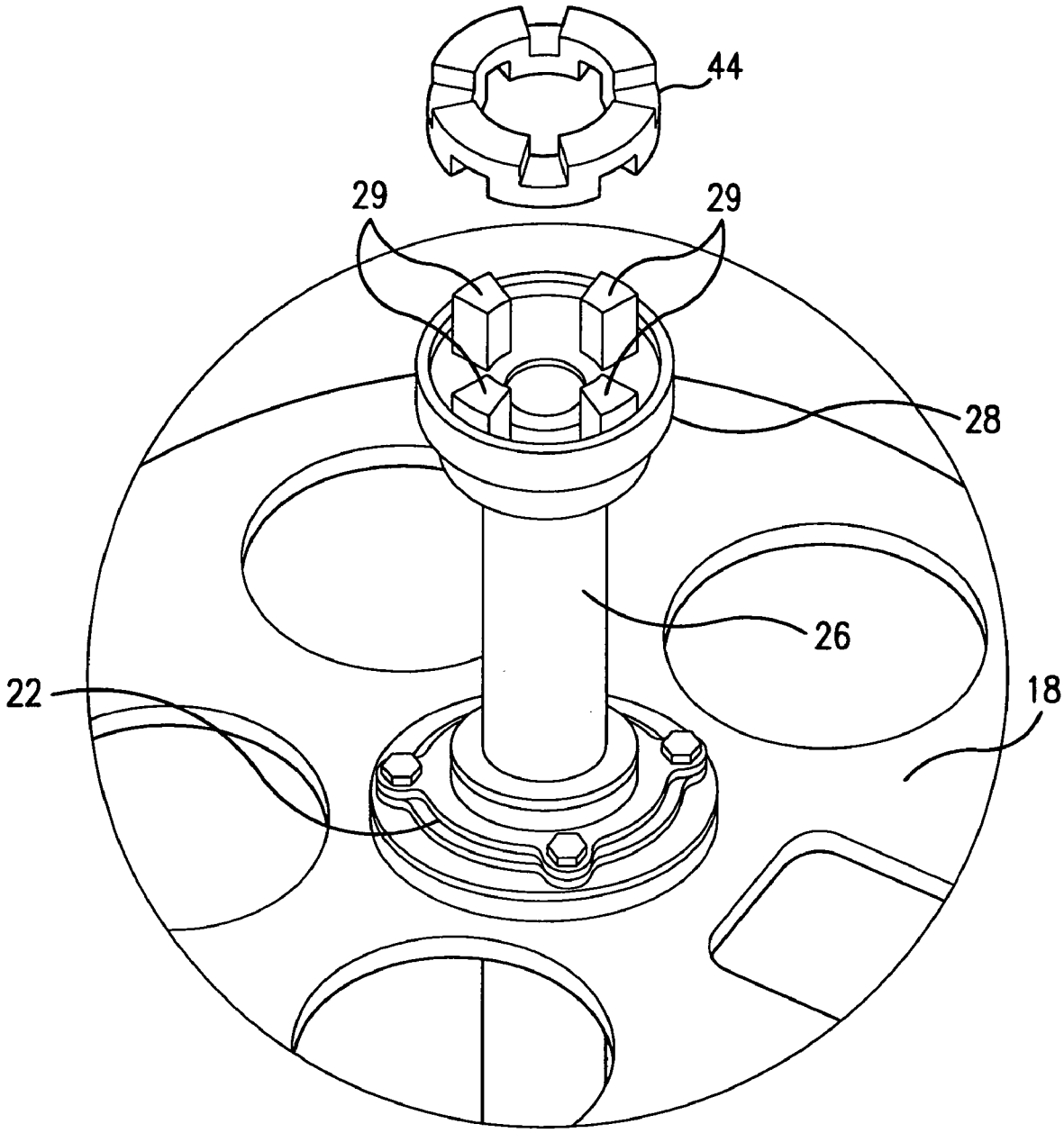
FIG. 5 is a perspective view of a portion of the vibration system and illustrating the shaft coupling arrangement with the vibrator assemblies.

As shown in the drawings, the jaws 29 of the coupling hubs 28 and 30 will mesh together with the jaws 37 of the vibrator coupling hubs 36 only in discrete positions, in the illustrated embodiment this being four. When the hubs are thus meshed, a complete coupling between each end of the coupling shaft 26 and the vibrator assemblies 32 and 34 consists of two opposing jaw-type coupling hubs the jaws of which are engaged. Preferably, as shown in FIG. 5, the engaged hubs of each coupling are provided with an elastomeric element 44 sandwiched in between them. The element 44 has recesses molded into it that allow the jaws of the opposing coupling hubs to mesh into it without actually touching each other. The primary purpose of the coupling element 44 is to accommodate slight misalignment between coupled components. The more accurate the alignment between mating components, the longer the vibration system will last. The element 44 also prevents metal-to-metal contact and wear of the coupling hubs, and the elements 44 can be replaced without replacing the rest of the coupling assembly.

When assembling the vibration system of the invention, the coupling shaft 26 along with the two shaft support bearings 22 and 24 are installed first in the inner mold 10. When installing the vibrator assemblies 32 and 34 in the inner mold 10, the upper vibrator assembly 32 is installed first by mounting it on the upper vibrator mounting plate 14 with the vibrator coupling hub 36 engaging the upper shaft coupling hub 28 in any one of the four discrete positions defined by the jaws of the coupling hubs 28 and 36. When installing the lower vibrator assembly 34 on the lower mounting plate 16, the eccentric weights 42 of the lower assembly 34 are aligned by hand so that the jaws of the lower shaft coupling hub 30 and the coupling hub 36 of the lower vibrator assembly 34 engage in the one position, out of the four possible positions, that allows the eccentric weights 42 of the lower vibrator assembly 34 to line up directly with the eccentric weights 42 of the already installed upper vibrator assembly 32. This will assure proper alignment and synchronization of the vibrator assemblies 32 and 34. Proper and accurate coupling alignment will provide long life of the coupling elements and hubs, shaft bearings, and the internal bearings of the vibrator assemblies. Misalignment in either the radial (concentric), axial (distance), or angular (parallelism) directions will shorten the life of the coupling elements and vibrator bearings.

From the above description, it will be evident that the vibration system of the invention has numerous advantages over prior art systems. For example, the system of the invention reduces the vibration power required by eliminating the need to vibrate the additional weight of a separate vibration unit and also has a lower cost than one utilizing separate vibration units. Also, once installed, the coupling shaft 26 does not require removal for normal maintenance, but the vibrator assemblies 32 and 34 can be completely removed without disturbing the coupling shaft 26. Thus, the system of the invention allows for repair or replacement of either vibrator assembly without disturbing the coupling shaft or its alignment, thus simplifying these tasks. Moreover, the system of the invention provides for quick changeover of molds in the production machine because of the self-contained nature of the synchronizing assembly that requires no adjustments when connecting it to the vibrator assemblies.

Having thus described the invention in connection with the preferred embodiments thereof, it will be evident to those skilled in the art that various revisions can be made to the preferred embodiments described herein without departing from the spirit and scope of the invention. It is our intention, however, that all such revisions and modifications that are evident to those skilled in the art will be included within the scope of the following claims.

The invention claimed is:

1. A vibration system for machines for making concrete products such as concrete pipes and the like, which machines utilize a mold that includes an outer mold and an inner mold that provide an annular space into which concrete is introduced to form the concrete product, said vibration system comprising:

an inner mold having an inner surface that defines an interior space having a longitudinal axis;

upper and lower bearing mounting plates spaced apart along the longitudinal axis of the interior space and secured to the inner mold;

a coupling shaft bearing mounted on each of the bearing mounting plates;

a coupling shaft supported by and turnable in the coupling shaft bearings and having upper and lower ends extending beyond the upper and lower mounting plates;

a coupling hub fixed to each of the upper and lower ends of the coupling shaft;

upper and lower vibrator mounting plates secured to the inner mold beyond the upper and lower ends, respectively, of the coupling shaft;

an upper vibrator assembly that includes a drive motor mounted on the upper vibrator mounting plate and a lower vibrator assembly that includes a drive motor mounted on the lower vibrator mounting plate the upper and lower vibrator assemblies being positioned within the interior space of the inner mold; and upper and lower vibrator coupling hubs engageable with the respective coupling hubs at the upper and lower ends of the coupling shaft whereby the vibrator assemblies can be properly synchronized to run at the same speed and in the same direction.

2. The vibration system of claim 1 in which the coupling hubs at the ends of the coupling shaft and the vibrator coupling hubs are each of the jaw type having jaws that are engageable so as to couple the upper and lower vibrator assemblies, whereby the jaws provide for proper alignment of and transmission of torque between the upper and lower vibrator assemblies.

3. The vibration system of claim 2 in which the upper and lower vibrator assemblies each includes a motor rotating the vibrator coupling hub, and weights are eccentrically mounted with respect to the axis of rotation of the vibrator coupling hubs, the eccentric weights of the upper vibrator assembly being adjustable relative to the eccentric weights of the lower vibrator assembly to provide for proper alignment and synchronization of the vibrator assemblies.

4. The vibration system of claim 3 in which there is a first elastomeric coupling element positioned between the coupling hub of the upper vibrator assembly and the coupling hub at the upper end of the coupling shaft and a second elastomeric coupling element positioned between the coupling hub of the lower vibrator assembly and the coupling hub at the lower end of the coupling shaft, whereby the elastomeric coupling elements dampen vibration through the coupling shaft.

* * * * *